US007672473B2

(12) United States Patent
Horigome et al.

(10) Patent No.: US 7,672,473 B2
(45) Date of Patent: Mar. 2, 2010

(54) LOUDSPEAKER

(75) Inventors: Minoru Horigome, Yamagata (JP); Hiroshi Sato, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 1093 days.

(21) Appl. No.: 11/294,335

(22) Filed: Dec. 6, 2005

(65) Prior Publication Data

US 2006/0120552 A1 Jun. 8, 2006

(30) Foreign Application Priority Data

Dec. 7, 2004 (JP) ..... 2004-353604

(51) Int. Cl.
*H04R 1/00* (2006.01)
*H04R 9/06* (2006.01)

(52) U.S. Cl. ..... 381/433; 381/430; 381/409

(58) Field of Classification Search ..... 381/396, 381/409, 430, 433
See application file for complete search history.

(56) References Cited

U.S. PATENT DOCUMENTS 6,385,328 B1 * 5/2002 Yoo et al. ..... 381/412
7,151,840 B2 * 12/2006 Lenhard-Backhaus et al. ..... 381/396

FOREIGN PATENT DOCUMENTS

JP 2003-153382 5/2003

OTHER PUBLICATIONS

Tamon Saeki, "New Edition: Encyclopedia of Speaker & Enclosure," Seibundo Shinkosha Publishing Company, 2001, pp. 32-33.

* cited by examiner

*Primary Examiner*—Brian Ensey
(74) *Attorney, Agent, or Firm*—Arent Fox LLP

(57) ABSTRACT

In a loudspeaker, a lead wire of a voice coil is fastened to a diaphragm, and is extended along the diaphragm. A bottom surface of a frame supporting the diaphragm is placed so as to face against a rear surface of the diaphragm. A protrusion is formed on the bottom surface so as to protrude toward the rear surface of the diaphragm. Therefore, the loudspeaker can prevent the lead wire of the voice coil, which is extending along the diaphragm, from being broken. Further, the loudspeaker can prevent the forward protruding diaphragm from being crushed and damaged.

4 Claims, 2 Drawing Sheets

LOUDSPEAKER

BACKGROUND OF THE INVENTION

The present invention relates to a speaker, more particularly to a loudspeaker with a diaphragm for producing sounds from input voice signal.

There are many loudspeakers with various forms of the diaphragm, including a cone type speaker having a conical diaphragm, a dome type speaker having the diaphragm formed in a convex or concave shape in a direction of sound emission, or the like. The cone type speaker is widely used as low, middle, and high-frequency sound speakers as well as a full-range speaker. The dome type speaker is widely spread, especially as a speaker having a small diameter and a relatively small amplitude for playing back a high frequency band.

The cone and dome type speakers also have various forms of the diaphragm. It is known that a curved cone diaphragm of the cone type speaker can have a wider playback frequency band than that of a flat cone diaphragm (see pages 32 to 33 of "New edition: Encyclopedia of Speaker & Enclosure" supervised by Tamon SAEKI, Seibundo Shinkosha Publishing Company, Apr. 10, 2001). The curved cone diaphragm has a convexly curved surface in the direction of the sound emission. The flat cone diaphragm has a flat surface. The dome type speaker has a diaphragm that has a central part thereof formed to be convex in the direction of the sound emission, and a circular part around the central part also formed to be convex in the direction of the sound emission. An upper end of a voice coil bobbin is mounted between the central convex part and the circular convex part around the central convex part (see Patent Application Laid-open No. 2003-153382).

In the above loudspeaker, the voice coil bobbin is mounted on the diaphragm, and a voice coil wound around the voice coil bobbin is disposed in a magnetic gap of a magnetic circuit. A voice signal is input to the voice coil so as to generate vibrations of the voice coil bobbin, which is then transmitted to the diaphragm to produce sounds. In general, a lead wire of the voice coil is fastened to the diaphragm, and is extended along the diaphragm to a terminal of a speaker frame or a connecting end of a tinsel wire connected to the terminal of the speaker frame in order to input the voice signal to the voice coil (see Patent Application Laid-open No. 2003-153382).

In the loudspeaker as mentioned above, the lead wire is fastened to the diaphragm, and is extended along the diaphragm to the terminal of the speaker frame or the connecting end of the tinsel wire connected to the terminal of the speaker frame. In particular, the following problem occurs in the loudspeaker having the diaphragm, a curved surface of which is formed to be convex in the direction of the sound emission as described above. The curved surface of the diaphragm is deformed to a large extent when the surface of the diaphragm is touched by hands and therefore the convexly curved surface of the diaphragm is crushed. Consequently, the lead wire is easily broken.

Furthermore, when the foregoing loudspeaker having the forward protruding diaphragm is displayed in an exhibition or a store, the diaphragm is often crushed by hands due to human psychology that a person wants to crush things that are protruded. Therefore, there occurs a problem that commercial value of the display is reduced after the diaphragm is damaged.

SUMMARY OF THE INVENTION

The present invention is to solve the aforementioned problems as an example of the object. It is an objects of the present invention to prevent a lead wire of a voice coil from being broken, the lead wire being extended along a diaphragm, or to prevent the forward protruding diaphragm from being crushed and damaged.

In order to achieve the foregoing objects, the loudspeaker of the present invention has at least the following features according to the following aspects.

According to a first aspect of the present invention, the loudspeaker has a voice coil bobbin mounted on the diaphragm, and the voice coil disposed in a magnetic gap of a magnetic circuit. The voice coil is wound around the voice coil bobbin. A voice signal is input to the voice coil so as to generate vibration of the voice coil bobbin, which is then transmitted to the diaphragm to produce sounds. The lead wire of the voice coil is fastened to the diaphragm, and is extended along the diaphragm. A bottom surface of a frame supporting the diaphragm is placed in order to face the rear surface of the diaphragm. A protrusion is formed on the bottom surface of the frame so as to protrude toward the rear surface of the diaphragm.

BRIEF DESCRIPTION OF THE DRAWINGS

These and other objects and advantages of the present invention will become clearly understood from the following description with reference to the accompanying drawings, wherein.

DETAILED DESCRIPTION OF THE PREFERRED EMBODIMENTS

Hereinafter, an embodiment of the present invention will be described with reference to the attached drawings. In the embodiment described below, a dome type speaker will be described as an example, the present invention, however, is not limited thereto. The present invention can also be employed in speakers having other forms of a diaphragm, such as a cone type speaker.

Figure 1:
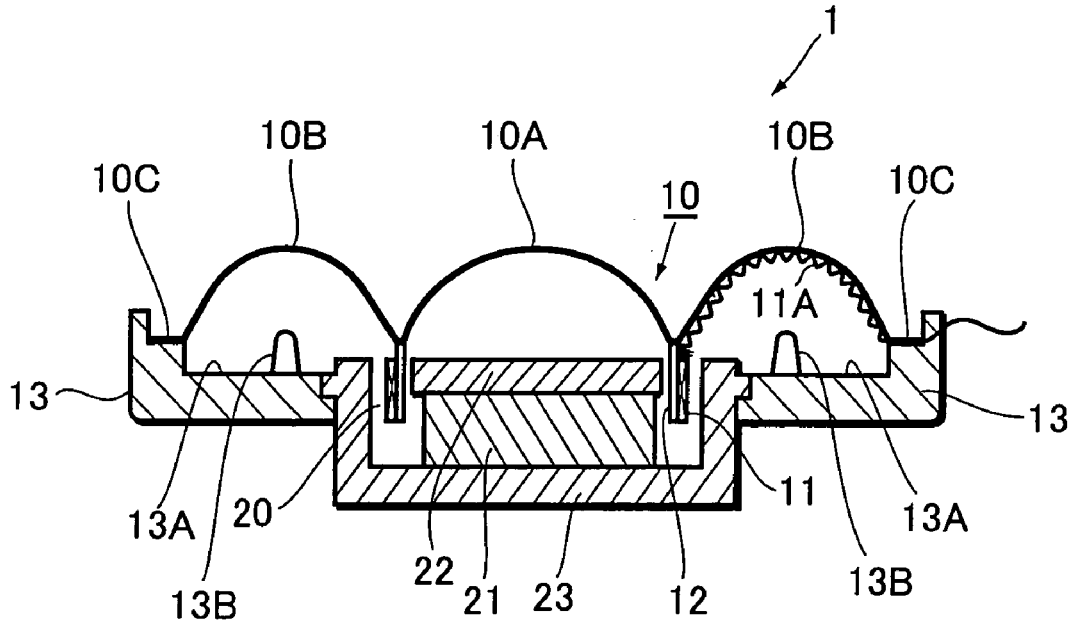
FIG. 1 is a sectional view showing a loudspeaker according to an embodiment of the present invention.

FIG. 1 is a sectional view showing a loudspeaker according to the embodiment of the present invention. A loudspeaker 1 includes a diaphragm 10. The diaphragm 10 has a convexly curved surface on the front side thereof. As exemplified here, a dome type diaphragm has a dome type convex portion 10A in the center thereof, and a circular convex portion 10B around the convex portion 10A.

In the above-described loudspeaker 1, a voice coil bobbin 12 is mounted on the diaphragm 10. A voice coil 11 is wound around the voice coil bobbin 12. The voice coil 11 is disposed in a magnetic gap 20 of a magnetic circuit composed of a magnet 21, an upper plate 22, and a yoke 23. A voice signal is input to the voice coil 11 so as to generate vibrations of the voice coil bobbin 12, which is then transmitted to the diaphragm 10 to produce sounds.

The upper end of the voice coil bobbin 12 is attached between the convex portion 10A in the center of the diaphragm 10 and the convex portion 10B around the convex portion 10A. A supported portion 10C formed on the outer edge of the convex portion 10B is supported by a supporting portion of a frame 13 formed of resin, or the like.

In the foregoing loudspeaker 1, a lead wire 11A for inputting the voice signal to the voice coil 11 is fastened to the rear surface of the diaphragm 10. The lead wire 11A is extended along the diaphragm 10 to a terminal attached on the frame 13 or outside the frame 13, or to a connecting end of a tinsel wire connected to the terminal. In the loudspeaker 1 according to the embodiment of the present invention, the bottom surface 13A of the frame 13 is placed in order to face the rear surface of the diaphragm 10. The frame 13 supports the supported portion 10C of the diaphragm 10. A protrusion 13B is formed on the bottom surface 13A so as to protrude toward the rear surface of the diaphragm 10. The protrusion 13B can be easily and integrally formed on the frame 13 if the frame 13 is formed by resin.

According to the aforementioned loudspeaker 1, the diaphragm 10 has the convexly curved surface protruding to the front side, to which the sound is emitted. Even if the convexly curved surface of the diaphragm 10 is crushed from the front side thereof by hands, the edge of the protrusion 13B keeps the convexly curved surface from being extremely deformed. Consequently, the above loudspeaker can prevent the lead wire 11A extended along the diaphragm 10 from being broken due to deformation of the diaphragm 10, and further prevent the diaphragm 10 from being crushed and damaged.

Figure 2:
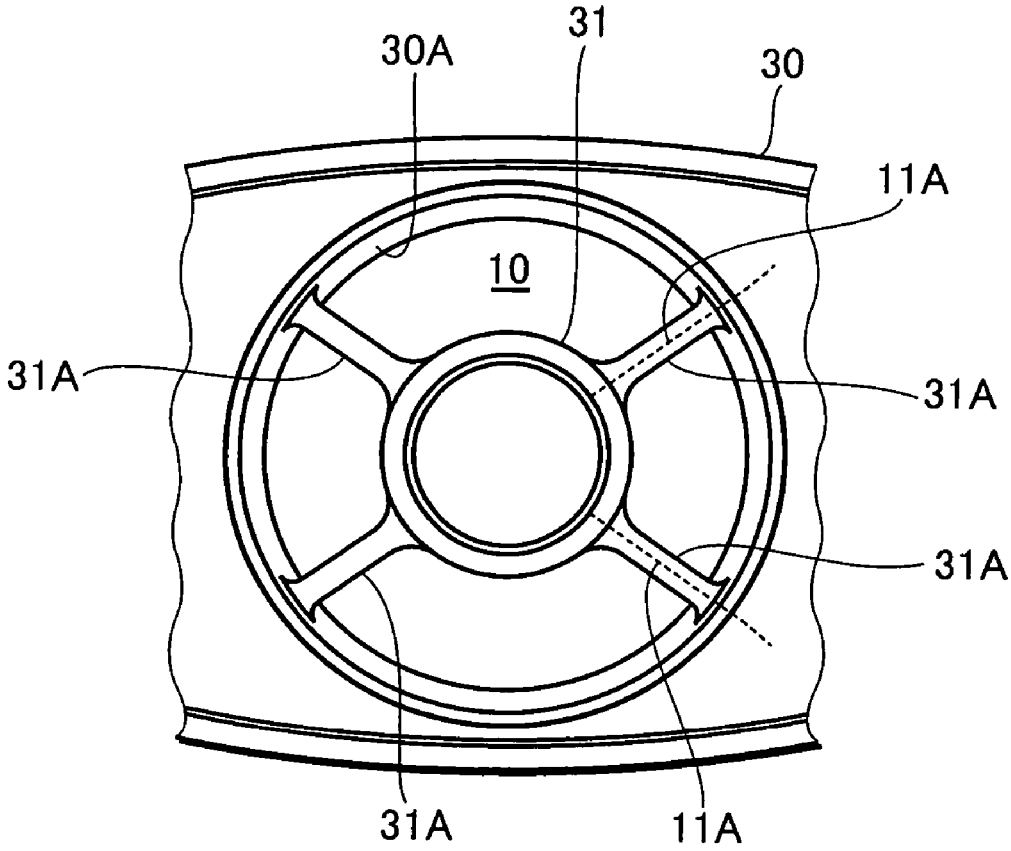
FIG. 2 is a plain view showing an example of a configuration of a decoration plate provided at the front of the loudspeaker.

FIG. 2 is a plain view showing an example of a configuration of a decorative plate provided at the front of the loudspeaker 1. The decorative plate 30 is provided with an equalizer 31 at the front of the central part of the diaphragm 10. A supporting member 31A of the equalizer 31 extends to an opening edge 30A of the decorative plate 30, which is formed along the outer edge of the diaphragm 10, and therefore the equalizer 31 is supported by the decorative plate 30.

According to the embodiment of the present invention, in the loudspeaker 1 having the above-mentioned decorative plate 30, the lead wire 11A of the voice coil 11 is disposed along the supporting member 31A of the equalizer 31. In this configuration, the supporting member 31A does not allow pressure to be applied from the above to the diaphragm, where the lead wire 11A is disposed, so as to protect the lead wire 11A. Furthermore, the breaking of the lead wire 11A due to the deformation of the diaphragm 10 can be prevented.

To sum up the characteristics of the loudspeaker 1 according to the embodiment of the present invention, one of the characteristics is as follows. The voice coil bobbin 12 is mounted on the diaphragm 10, and the voice coil 11 wound around the voice coil bobbin 12 is disposed in the magnetic gap 20 of the magnetic circuit. The voice signal is input to the voice coil 11 so as to generate the vibration of the voice coil bobbin 12, which is then transmitted to the diaphragm 10 to produce the sounds. The lead wire 11A of the voice coil 11 is fastened to the diaphragm 10, and is extended along the diaphragm 10. The bottom surface 13A of the frame 13 supporting the diaphragm 10 is placed in order to face the rear surface of the diaphragm 10. The protrusion 13B is formed on the bottom surface 13A of the frame 13 so as to protrude toward the rear surface of the diaphragm 10.

According to the other characteristics of the loudspeaker 1, the diaphragm 10 has the convexly curved surface on the front side thereof.

Furthermore, in the loudspeaker 1 having the above characteristics, the lead wire 11A is disposed along the supporting member 31A of the equalizer 31 provided at the front of the diaphragm 10.

The loudspeaker 1 according to the embodiment of the present invention having the above characteristics can prevent the lead wire 11A of the voice coil 11 from being broken. The lead wire 11A is extended along the diaphragm 10. Moreover, the above loudspeaker can prevent the forward protruding diaphragm 10 from being crushed and damaged.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A loudspeaker comprising:

a diaphragm;

a voice coil bobbin mounted on the diaphragm;

a voice coil wound around the voice coil bobbin and disposed in a magnetic gap of a magnetic circuit, said voice coil receiving a voice signal to generate a vibration of said voice coil bobbin, which is then transmitted to said diaphragm to produce sounds;

a lead wire of said voice coil fastened to a rear surface of said diaphragm, said lead wire being extended outwardly along the diaphragm;

a frame for supporting the diaphragm, said frame being disposed so as to face against the rear surface of said diaphragm; and means provided on a bottom surface of said frame for preventing said diaphragm from being crushed from a front side thereof and preventing the lead wire from being broken due to deformation of the diaphragm.

2. The loudspeaker according to claim 1, wherein said diaphragm has a convexly curved surface forwardly.

3. The loudspeaker according to claim 1, wherein said lead wire is extended behind a supporting member of an equalizer provided at a front side of said diaphragm.

4. The loudspeaker according to claim 1, wherein said means is a plurality of protrusions.

* * * * *